US005560135A

United States Patent [19]

Ciluffo

[11] Patent Number: 5,560,135

[45] Date of Patent: Oct. 1, 1996

[54] AUDIO CONTROLLED GUN LOCKING MECHANISM

[76] Inventor: Gary Ciluffo, 103 Henderon Hill, Vincennes, Ind. 47594

[21] Appl. No.: 535,559

[22] Filed: Sep. 28, 1995

Related U.S. Application Data

[62] Division of Ser. No. 368,371, Jan. 4, 1995.

[51] Int. Cl.[6] ..... F41A 17/06; F41A 17/54

[52] U.S. Cl. ..... 42/70.07; 42/70.11

[58] Field of Search ..... 42/70.01, 70.06, 42/70.07, 70.08, 70.11; 340/825.31; 367/198

[56] References Cited

U.S. PATENT DOCUMENTS

| | | | |
|---|---|---|---|
| 4,856,072 | 8/1989 | Schneider et al. | 340/825.31 |
| 5,392,552 | 2/1995 | McCarthy et al. | 42/70.07 |
| 5,419,068 | 5/1995 | Pages et al. | 42/70.07 |
| 5,459,957 | 10/1995 | Winer | 42/70.11 |

*Primary Examiner*—Stephen C. Bentley
*Attorney, Agent, or Firm*—Polster, Lieder, Woodruff & Lucchesi, L.C.

[57] ABSTRACT

A firearm (W) is for discharging a projectile such as bullet (B) through a barrel (L). The firearm includes a firing mechanism (F) for firing the bullet through the barrel. The firing mechanism includes a trigger (T) which is operable by the person using the firearm to fire the weapon. A firing pin (P) is operatively connected to the trigger for contacting a cartridge (C) and effecting discharge of the bullet. A gun lock (200) is provided to inhibit operation of the firing mechanism by enclosing trigger (T). A cover piece (202) fits about the trigger. A blocking pin (228) fits behind the trigger and is movable by an electro-magnet (240) which is activated by a processor (218) which evaluates a word or phrase spoken into an audio recognition unit (214) mounted on the cover piece. Received audio signals are directed to the audio recognition unit. If a received audio input corresponds to a predetermined audio frequency signal, the blocking element is moved from its inhibiting position to its enabling position.

4 Claims, 2 Drawing Sheets

AUDIO CONTROLLED GUN LOCKING MECHANISM

This is a divisional of copending application Ser. No. 08/368,371, filed on Jan. 4, 1995.

BACKGROUND OF THE INVENTION

This invention relates to firearms safety and more particularly to a safety mechanism which can be installed during initial fabrication of a firearm, or as a retrofit installation, or as a safety lock mechanism selectively installed and removable from the firearm, the mechanism disabling the firing mechanism of the weapon unless a properly voice coded input is supplied to the safety mechanism to either enable the firing mechanism or allowing the safety mechanism to be removed from the firearm so it can then be fired.

Gun safety is a universal concern. There are countless news stories of individuals, particularly children, who are killed or maimed because of the inadvertent discharge of a firearm. Stories also abound about the person who shoots himself while cleaning a weapon he or she knew was unloaded. Or, there are the shootings which occur because someone wrongly suspected that a person was a thief or robber who had broken into a home only to find that it was a loved one who turned out to be in the wrong place at the wrong time. The tragedy which results from these situations has far reaching consequences for both the family or families of those involved, and the community. At the same time, there are also numerous incidents where a firearm is stolen during the burglary of a home, car, or business, with the weapon subsequently being used by a criminal to kill someone during the commission of another crime.

While it may impossible to ever fully stop these kinds of incidents, absence the complete abolition of firearms and their removal from the American scene, it may be possible to substantially reduce the loss of life and terrible injuries which result from either the accidently discharge of a gun or the potential use of a stolen firearm by a criminal. As a result many more people will be able to lead active and productive lives and a major cause of accidental death may be eliminated from society.

SUMMARY OF THE INVENTION

Among the several objects of the present invention may be noted the provision of a safety mechanism for installation on a firearm to prevent inadvertent discharge of the firearm or use of the weapon by a person not intended to use it; the provision of such a safety mechanism which is installed on the firearm during its initial fabrication; the provision of such a safety mechanism which can also be retrofit on the firearm; the provision of such a safety mechanism which can also be implemented as a safety lock mechanism which is selectively installed and removed from the firearm; the provision of such a safety mechanism which, regardless of how embodied safely, easily and efficiently disables the firing mechanism of the weapon; the provision of such a safety mechanism which requires a properly voice coded input to be supplied to the safety mechanism to either enable the firing mechanism, or allow the safety mechanism to be removed from the firearm so it can then be fired; the provision of such a safety mechanism in which the voice of the owner or user of the weapon is encoded into a voice pattern recognition system which responds only to the proper voice enunciating a selected coded input in order for the safety mechanism to enable the firing mechanism of the weapon so it can be discharged; the provision of such a safety mechanism which is a fail safe device, which, if it fails, maintains the firearm in a disabled condition; the provision of such a voice coding system in which the manufacturer of a weapon or a gunsmith is capable of producing a chip selectively encoded with a word or words spoken by the owner or user of the weapon and installing the chip in the weapon or safety lock so the weapon can be enabled or the lock removed only by the owner or speaker repeating the coded input at the weapon or lock; the provision of such a safety mechanism including a receiver and processing circuitry for determining if a received input is the proper input to enable the weapon or remove the lock so the weapon can be fired; the provision of such a safety mechanism to further enable the owner or user to enunciate a second coded input to subsequently reactivate the safety mechanism and disable the weapon; and, the provision of such a safety mechanism which, cannot be removed from the weapon without rendering it unusable so that use of the weapon is limited to only the person whose voice is recognized by the safety mechanism and only if that individual speaks the appropriate encoded word or phrase.

In accordance with the invention, generally stated, a firearm is for discharging a projectile such as bullet through a barrel. The firearm includes a firing mechanism for firing the bullet through the barrel. The firing mechanism includes a trigger which is operable by the person using the firearm to fire the weapon. A firing pin is operatively connected to the trigger for contacting a cartridge and effecting discharge of the bullet. A safety mechanism is provided to inhibit operation of the firing mechanism. The safety mechanism includes a blocking element movable into and out of contact with the firing mechanism. The blocking element has a first position inhibiting the firing mechanism from discharging the projectile, and a second position at which the firing mechanism is enabled to discharge the projectile. An audio receiver mounted on the firearm receives audio frequency signals such as a word or words spoken by the person using the firearm. An audio recognition unit also mounted on the firearm has an input from the receiver. Received audio signals are directed to the audio recognition unit which includes a processor for processing the received audio frequency signal. If the received signal corresponds to a predetermined audio frequency signal, the blocking element is moved from its inhibiting position to its enabling position.

Other objects and features will be in part apparent and in part pointed out hereinafter.

BRIEF DESCRIPTION OF THE DRAWINGS

Corresponding reference characters indicate corresponding parts throughout the drawings.

DESCRIPTION OF A PREFERRED EMBODIMENT

Figure 2:
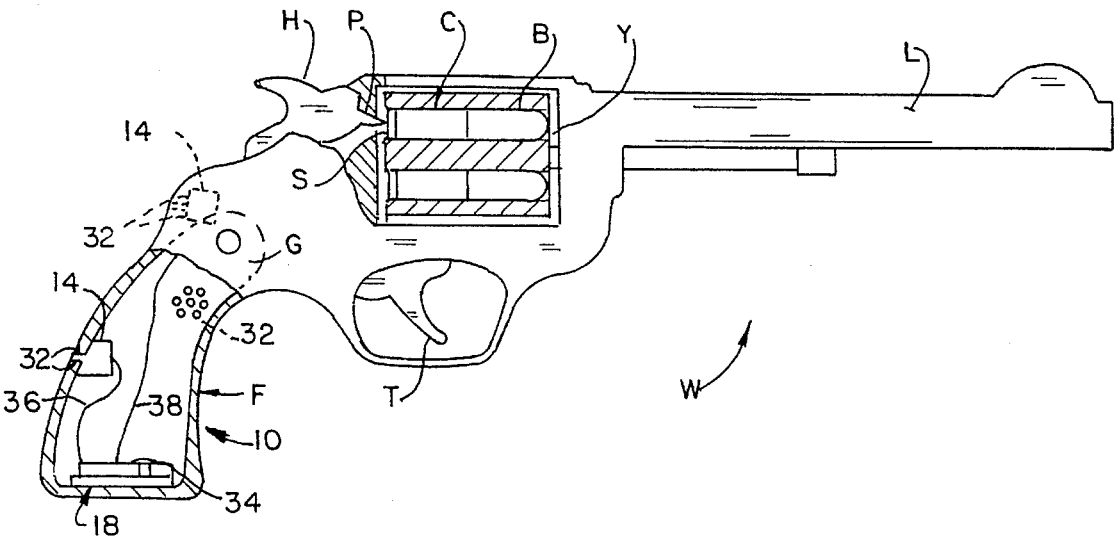
FIG. 2 is representation of a revolver, partially broken away, and indicating installation of the safety mechanism.

Referring to the drawings, a firearm or weapon such as a revolver (W) is shown in FIG. 2. The revolver is of a conventional construction having cylinder Y in which bullets B are loaded. When the person using the weapon pulls its trigger T, a hammer H is first drawn back through a lever mechanism (not shown). When drawn back sufficiently far, the hammer is released by a spring mechanism (also not shown). A firing pin P located on the front portion of the hammer is then driven into the base S of a cartridge C. The impact ignites a detonator explosive contained in the cartridge. The detonator explosive, in turn, ignites a propellant explosive also contained in the cartridge. The resulting explosion produces a rapidly expanding gases which propel a bullet B through the barrel L of the revolver. While not shown, it will be understood that automatic handguns, rifles, and shotguns, operate in a similar fashion. In some instances, the hammer of the weapon may first be dram to a cocked position prior to pulling on the trigger. Also, regardless of the type of weapon, the operative components are mounted to some type of support frame F.

Almost all weapons have a safety mechanism which is typically a manually operated lever arm or switch (not shown) located on the side of the weapon. The switch is movable between a SAFE position and a FIRE position. When moved to the SAFE position, a pin (not shown) is moved to a blocking position which locks the firing mechanism and prevents the weapon from being fired. Because it is a simple mechanical mechanism, the safety feature is, unfortunately, readily defeated. There are too many instances where children or adults, have been killed or seriously wounded because the safety lever was inadvertently not engaged, or was disengaged, and the weapon was discharged when no one thought it could be.

In accordance with the present invention, a safety mechanism 10 is installed on the firearm to prevent its unintended firing. Mechanism 10 does this by preventing or inhibiting operation of the weapon's firing mechanism. In one embodiment of the invention it does this by preventing a force exerted on the trigger from being transferred to through the firing mechanism to the hammer. In another embodiment of the invention, a safety lock is mounted to the frame of the weapon about the trigger to prevent access to the trigger. Importantly, both embodiments of the invention are voice controlled or operated. At the time of manufacture of the weapon, or as a retrofit when the weapon is purchased or serviced, a recording is made of the user's voice saying a particular code word or phrase. This recording is then processed to produce a reference audio signal which is then stored in the memory of a processor chip. The chip is then installed in the weapon. Thereafter, to enable the weapon so it can be fired, the user must first unlock the weapon's safety mechanism by repeating the word or phrase. A processing electronics installed in the weapon and including the chip, process the speech. A determination is made as to whether a) the speech is that of the proper user and 2) if the word or phrase is correct. Only if both conditions are met is the weapon enabled so it can be fired. If either condition is not met, the weapon remains disabled.

Figure 1:
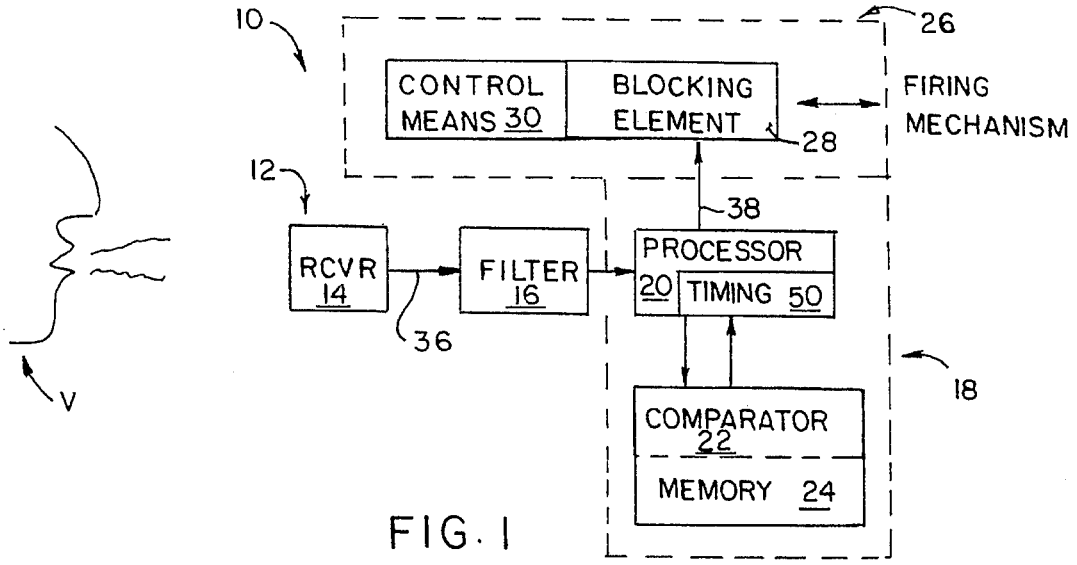
FIGS. 1 is a block diagram of a safety mechanism of the present invention.

Referring to FIG. 1, safety mechanism 10 is shown in block diagram form to include a receiving means 12 constituted by an audio frequency receiver 14. Words spoken by a user U are directed at the receiver. A filter 16 filters extraneous noise from the received audio signal. A processing means 18 includes a processor 20 for processing a received audio frequency signal. Means 18 also includes a comparator 22 which includes a memory 24 in which is stored the predetermined audio input information. Once a received audio frequency signal is processed, it is compared with the stored information by the comparator. If the two conditions noted above are satisfied, an appropriate signal is supplied to a blocking means 26. Means 26 includes a blocking element 28, and a control means 30 for moving the control element into from a blocking position inhibiting firing of the weapon to an unblocking position in which the firearm can be discharged.

Figure 3:
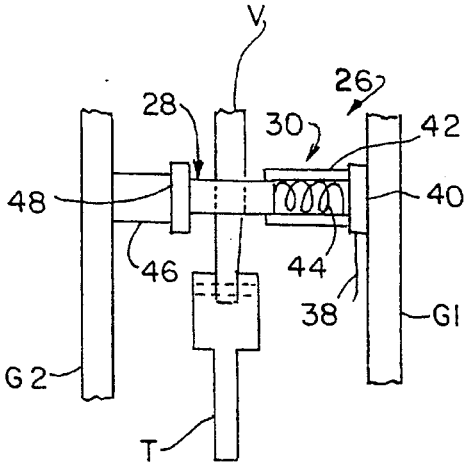
FIG. 3 is a representation of a first blocking element for preventing firing of the weapon.

Referring to FIGS. 1 and 3, safety mechanism 10 is shown implemented on a revolver. Here, receiver 14 is mounted to frame F of the weapon. As shown in FIG. 1, the receiver can be located at different locations on the frame, preferably on the portion of the frame defining the grip of the revolver. The receiver may attached to the frame in any suitable manner. Openings 32 are drilled through the frame at the location of the receiver to permit the word or phrase spoken by the user to be received. The receiver can be installed to the frame so the holes are located in a "line-of-sight" from the user's mouth when user is holding the weapon at arm's length and pointing it at a target. Alternately, the receiver can be attached to the inside face of one of the grips G which attaches to the frame and facilitates the user holding the weapon. In this instance, the openings 32 are made in the grip.

Processing means 18 is installed on the portion of frame F forming the base of the grip. In addition to the processor 20 and comparator 22 components referred to above, processing means 18 further includes a battery 34 for powering the safety mechanism. The receiver output is transmitted to the processing means over a conductor 36. The processing means output to the blocking means is supplied over a control line 38.

In FIG. 3, control wire 38 is shown connected to an electro-magnet 40 of control means 30. The electro-magnet is mounted on the inside face of one of the handgrips G1 of the firearm. Extending inwardly (horizontally as viewed in FIG. 3) from the electro-magnet is a sleeve 42 in which is seated a spring 44. A post 46 extends inwardly from the inside face of the opposite handgrip G2. A permanent magnet 48 is mounted to the inner end of this post. Blocking element 28 comprises a pin fitted in a guide sleeve 42 and urged outwardly from the sleeve by spring 44. Magnet 48 further exerts a force on the pin drawing it out of the sleeve. In FIG. 3, pin 28 is positioned so that it blocks movement of a lever V to which trigger T is connected. As shown, exertion of a force on the trigger cannot cause the weapon to be fired because pin 28 inhibits operation of the firing mechanism.

When the proper user of the weapon speaks the appropriate word or phrase into receiver 14, the resulting output from processing means 18 energizes electro-magnet 40. Pin 28, which is formed of a magnetic material, is now with&am fully into sleeve 42 by the force exerted by the electro-magnet. This force is sufficient to overcome both the spring force on the pin and the attractive force exerted by magnet 48. So long as the voice operated safety mechanism is off, the firing mechanism is operable and pulling on the trigger causes the weapon to be fired.

When the gun is to be rendered "safe" or inoperative, the user can say another word or phrase into the receiver, this word or phrase being one selected to cause the safety mechanism to be re-enabled. Speaking this word or phrase causes the signal to the electromagnet to be removed. Spring 44 then urges the pin against magnet 48 to move the pin back into its blocking position. Alternatively, processing means may include a timing means 50. The timing means would allow the electro-magnet to be powered only for a specified interval after the proper word or phrase spoken into receiver 14 by the designated user causes the electro-magnet to be energized. An important feature of the safety mechanism is that it is "fail safe". That is, if the battery fails, a wire breaks, the processing means doesn't work properly, the operation of spring 44 and magnet 48 insure that pin 28 is held in its blocking position so the weapon cannot be fired.

It will be noted that the safety mechanism is readily accessible so that the portion of the processing means in which the memory is installed can be replaced. This would done, for example, if the weapon were sold. This allows the processing means to be reconfigured to respond to a word or phrase spoken by the new user.

Figure 4:
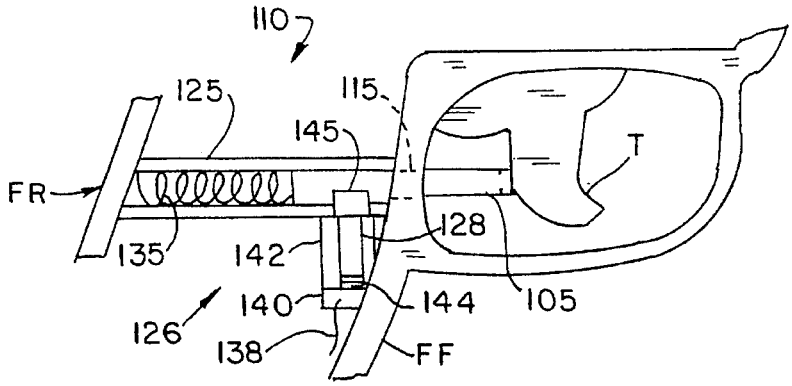
FIG. 4 is a representation of a second blocking element for preventing the firing.

Referring to FIG. 4, an alternate embodiment of the safety mechanism is indicated generally 110. In this embodiment, a bar 105 is reciprocally movable through an opening 115 formed in frame F behind trigger T. The bar moves through a guide 125 which extends from the rear grip portion FR of the frame to the front grip portion FF of the frame. A spring 135 urges the bar outwardly to bear against the backside of the trigger. A detent 145 is formed on the underside of the bar. The width of the detent corresponds to the diameter of blocking element or pin 128. Blocking means 126 includes an electro-magnet 140 mounted on the inside face of the front grip portion of the frame beneath the bar 105/guide 125 assembly. A sleeve 142 extends upwardly from the electro-magnet to position pin 128 beneath the detent when bar 105 is fully extended as shown in FIG. 4. A spring 144 seated in sleeve 142 urges pin 128 upwardly into the detent.

When pin 128 is in its blocking position, it is pushed upwardly into the detent by spring 144. In this position, it prevents rearward movement of bar 105 when trigger T is squeezed. The weapon cannot be fired. When the proper word or phrase is spoken by the proper individual, a signal over line 138 from processing means 18 energizes the electromagnet. Pin 138 is fully withdrawn into sleeve 142 by the force of the electro-magnet. Bar 105 is now movable against the force of spring 135, when the trigger is squeezed, so the weapon can be fired. As before, when the electro-magnet is de-energized, spring 142 moves pin 128 back into its blocking position. Also as before, mechanism 110 is fail safe because if a fault or failure in the mechanism occurs, spring 142 holds pin 128 in its blocking position.

Figure 5:
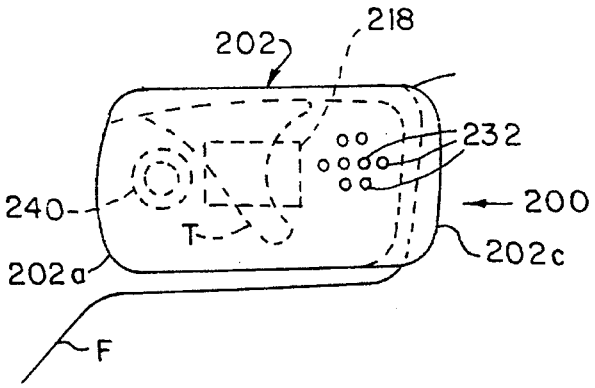
FIG. 5 is an elevational view of a second embodiment of the invention incorporated into a trigger lock for installation on a weapon; and, FIG. 6 is a plan view of the lock.
Figure 6:
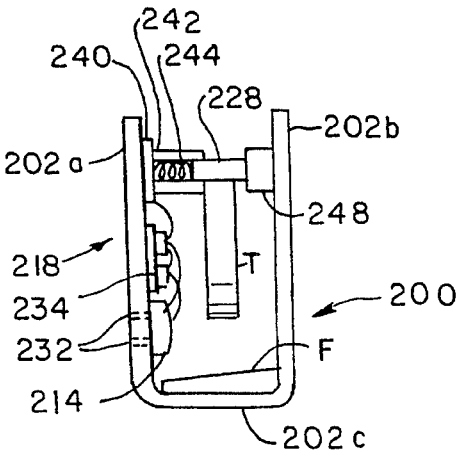

Referring to FIGS. 5 and 6, a second embodiment of the audio controlled gun lock mechanism is indicated generally 200. Unlike the previous embodiment, embodiment 200 is designed to fit and enclose the trigger T of the firearm. Thus, there are no components which require installation within the weapon. In FIG. 5, safety mechanism 200 is shown to enclose the trigger with a U-shaped cover piece 202 that fits about the trigger guard portion of the frame. Cover 202 has side pieces **202*a*, 202*b*, and a front section 202*c* which abuts against the front of the trigger guard portion of frame F. The length of the cover is sufficient for the cover, when in place, to enshroud the trigger so no one has access to it. An audio receiver 214 is attached to the inside wall of side piece 202*a*. Openings 232 extend through the side piece to provide an audio path to the receiver. A processing means 218 is also attached to the inside wall of side piece 202*a*. A battery 234** supplies power to the control mechanism. The processing means operates in the manner previously described to evaluate a received audio input and determine if it matches the predetermined audio information stored in a memory portion of the processing means.

A blocking element 228 comprises a pin made of a magnetic material which, when the cover is in place, fits behind trigger T and extends transversely of the trigger. The cover cannot be removed, because the trigger blocks movement of the pin to lock the cover in place. An electromagnet 240 is affixed to the inside wall of side piece **202*a*. A permanent magnet 248 is mounted to the inside wall of side piece 202*b* opposite the electromagnet. Pin 228 is received in a sleeve 242 extending outwardly from the electromagnet. A spring 244** seated in the sleeve against the electro-magnet urges the pin toward the permanent magnet.

To install the lock, pin 228 can be manually pushed into sleeve 244. The relative lengths of the pin and sleeve are such that the pin can be fully withdrawn into the sleeve. And, the length of the sleeve is such that it does not interfere with the installation or removal of cover 202 when pin 228 is fully withdrawn into the sleeve. When pin 228 is released, the attractive force of magnet 248, and the force of spring 244 positions the pin as shown in FIG. 6. When the user of the weapon desires to remove the safety mechanism, he speaks the appropriate word or phrase into the speaker. If the previously described conditions are met, the processing supplies an output to the electro-magnet to energize it. When energized, the force exerted on the pin by the electromagnet overcomes the force exerted thereon by the spring and permanent magnet and the pin is withdrawn into sleeve. The safety mechanism is now removed from the trigger guard and the weapon can now be fired.

It will be understood that safety mechanism 200 can be used in conjunction with safety mechanism 10 or 110. That is, once cover 200 is removed, the user may still have to enable the weapon in the mariner previously described with respect to operation of safety mechanisms 10 or 110.

With respect to the safety mechanisms described, it will be appreciated that their construction can differ from that described. For example, battery 34 or 234 could be a solar powered battery which could be built into the grip of the weapon or the side piece of the cover. All of the processing electronics could be incorporated on a single chip to facilitate installation of the safety mechanism. And, the receiver and processing means can be installed on the same base so that fewer pieces have to be installed.

What has been described is a safety mechanism for installation on a firearm to prevent its inadvertent discharge of the firearm or use by someone not intended to use it. The safety mechanism may be is installed on the firearm during its initial fabrication; or; it can also be retrofit on the firearm. It is also implemented as a safety lock mechanism which is selectively installed and removed from the firearm. Regardless of how embodied, the safety mechanism safely, easily, and efficiently disables the firing mechanism of the weapon so the weapon cannot be discharged. The safety mechanism is an audio controlled mechanism requiring a properly voice coded input to be supplied to it. This either enables the firing mechanism, or allows the safety mechanism to be removed from the firearm so it can then be fired. In use, the voice of the owner or user of the weapon is encoded into a voice pattern recognition system which responds only to that selected voice enunciating a selected coded input. If the voice and coded message are subsequently received by the mechanism, it enables the firing mechanism of the weapon or allows the trigger lock to be removed. The safety mechanism which is fail safe in that if it fails the firearm remains disabled. For coding purposes, the manufacturer of the weapon or a gunsmith can produce a chip selectively encoded with a word or words spoken by the owner or user of the weapon. After encoding, the chip is installed in the weapon or safety lock so the weapon can be enabled, or the lock removed, by the owner or speaker repeating the coded input into a receiver comprising part of the weapon or lock. The safety mechanism also includes processing circuitry for ascertaining if a received input is the proper one to enable the weapon or remove the lock. The safety mechanism further allows the owner or user to enunciate a second coded input to subsequently reactivate the safety mechanism and disable the weapon. Finally, the safety mechanism is tamper proof in that it cannot be removed from a weapon without rendering it and the weapon unusable. Accordingly, use of the weapon is limited to only the person whose voice is recognized by the safety mechanism; and, only if that individual speaks an appropriate word or phrase.

In view of the foregoing, it will be seen that the several objects of the invention are achieved and other advantageous results are obtained.

As various changes could be made in the above constructions without departing from the scope of the invention, it is intended that all matter contained in the above description or shown in the accompanying drawings shall be interpreted as illustrative and not in a limiting sense.

Having thus described the invention, what is claimed and desired to be secured by Letters Patent is:

1. A safety lock for use on a weapon having a firing mechanism including a trigger operable by a user of the firearm to activate the firing mechanism and fire a bullet from the weapon, the weapon having a frame on which components of the weapon are assembled, the safety lock including:

cover means fitting onto the frame and about the trigger to surround the trigger and prevent access to it, said cover means comprising a single piece cover which fits over a trigger guard of the weapon; and, a locking mechanism attached to the cover means for locking the cover in place and for releasing the cover means for removal from about the trigger, the locking mechanism including:

latch means extending from one side of said cover piece toward the other behind the trigger to contact the trigger or trigger guard if an attempt is made to remove said cover when said latch means is in a locking position, said latch means being movable from its locking position latching the locking mechanism so it cannot be removed to an unlocking position in which the cover means is removable from about the trigger;

receiving means mounted on the cover means for receiving audio frequency signals; and, audio recognition means also mounted on the cover means and receiving an audio frequency input from the receiving means, said audio recognition means including processing means for processing received audio frequency signals to determine if a received signal corresponds to a predetermined audio frequency signal to move the latch means from its locking position to its unlocking position.

2. The safety lock of claim 1 further wherein an input to the receiver is formed in the cover means.

3. The safety lock of claim 2 wherein said processing means includes a memory means in which is stored information corresponding to a predetermined audio input signal spoken by a person using the lock, comparing means for comparing the received audio signal with the stored information to determine if the received signal matches the predetermined audio input signal, and means responsive to an output from the comparing means when a match occurs to move the latch means to its unlocking position.

4. The safety lock of claim 3 wherein the means responsive to the comparing means output is a fail safe means by which the latch means remains in its locking position if the locking mechanism fails.

* * * * *